United States Patent [19]

Pfeifer

[11] Patent Number: 4,959,932

[45] Date of Patent: Oct. 2, 1990

[54] RAIN GUTTER SCREEN

[76] Inventor: Lee W. Pfeifer, 3137 Sweetwater Springs Blvd., Apt. 141, Spring Valley, Calif. 92098

[21] Appl. No.: 392,644

[22] Filed: Aug. 11, 1989

[51] Int. Cl.[5] ..... E04D 13/00

[52] U.S. Cl. ..... 52/12

[58] Field of Search ..... 52/12

[56] References Cited

U.S. PATENT DOCUMENTS

| | | | |
|---|---|---|---|
| 2,284,440 | 4/1940 | Morrissey | 52/12 |
| 2,636,458 | 4/1953 | Harris | 52/12 |
| 2,734,467 | 6/1950 | Steele | 52/12 |
| 3,295,264 | 1/1967 | Olson | 52/12 |
| 4,418,504 | 12/1983 | Lassiter | 52/12 |
| 4,573,290 | 3/1986 | Fleming | 52/12 |
| 4,745,710 | 5/1988 | Davis | 52/12 |
| 4,841,686 | 6/1989 | Rees | 52/12 |
| 4,856,237 | 8/1989 | Wigle | 52/12 |

*Primary Examiner*—Carl D. Friedman

*Attorney, Agent, or Firm*—Andsel Group, Inc.

[57] ABSTRACT

An improved rain gutter screen having simplified means for installation on roofs having conventional eaves rain gutters. The screening material being horizontal layers of heavy gage, large mesh reinforcing screening and smaller gage, small mesh material facilitating the separation of gravel and twigs or the like from the water and preventing clogging. The front and back edges of the gutter screen using a flexible, bondable material for attachment to the roof support portion and the eave gutter end edge. The gutter screen sections are installed edge to edge along the top of gutter and fastened by vertical pins along the intersecting edges.

1 Claim, 1 Drawing Sheet

RAIN GUTTER SCREEN

BACKGROUND OF THE INVENTION

1. Field of the Invention

The instant invention relates to drain shields for eave gutters in the form of screening sections placeable along the interface of the roof line and the rain gutter. The purpose of the screening is to prevent leaves, gravel and other debris from impairing the proper function of the gutter.

2. Description of the Prior Art

Many different designing of gutter screens are disclosed in the prior art. A pertinent prior art patent is U.S. Pat. No. 4,573,290 Fleming which discloses a drain shield in the form of screen sections adapted to be assembled end-to-end along a eave gutter. The improvement being a longitudinal vertical spacing along the roof line for diverting water into the gutter while causing leaves, gravel and other debris to be carried over and discharged beyond the edge of the gutter. U.S. Pat. No. 4,745,710 Davis, discloses spaced elongated ribs having tapered and concave ends providing assistance to propel leaves and other debris to the edge of the gutter while allowing the water to drain into the gutter.

SUMMARY OF THE INVENTION

The principal objective of the instant invention is to provide a improved design gutter screen comprising a laminate of 2 or more sheets of various types of mesh which facilitates the separation of water from foreign matter and having improved methods for installing the gutter screen to the roof/gutter interface. Another objective of the instant invention is to provide orifices to accommodate draining the minor water deflection caused by dew.

Installation of the gutter screen is facilitated by providing a depth gage to determine the placement of the leading edge of the screen beneath the end shingles, or other roofing material, at the roof edge and means for attaching the discharge edge of the screen to the inside and outside edge of the cave gutter. The installation of the gutter screen end-to-end is further facilitated by means of pins to connect the individual sections into one continuous length of screening.

DETAILED DESCRIPTION OF THE PREFERRED EMBODIMENTS

Figure 1:
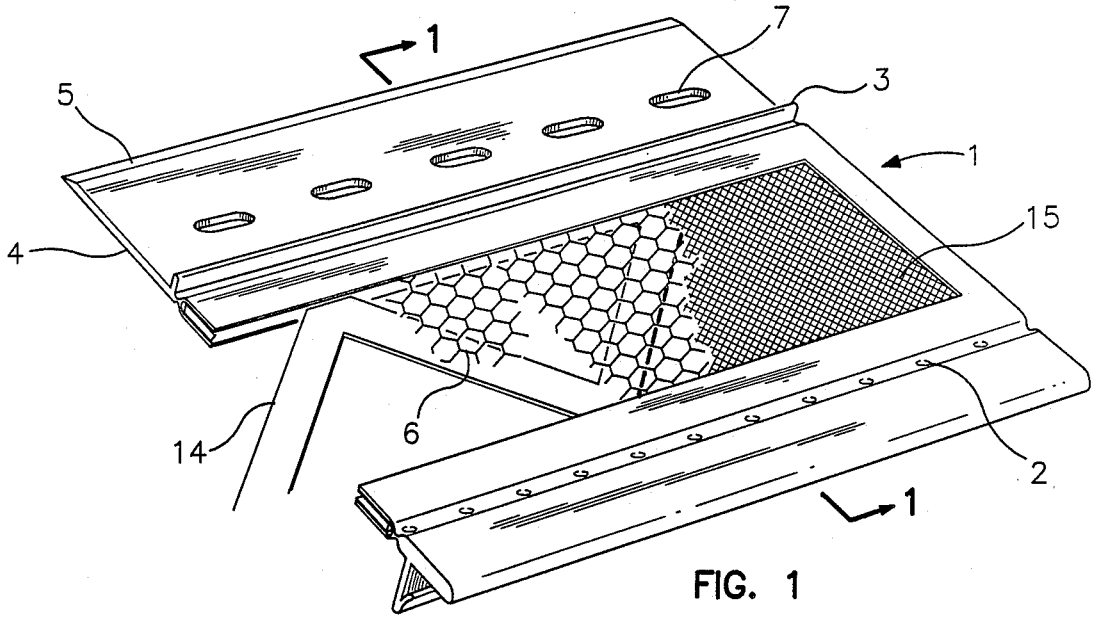
FIG. 1 is a top perspective view of a single section of rain gutter screen.

Referring to FIG. 1 the laminated gutter screens 1 with dew drip orifices 2, the depth gage 3, roof attachment tab 4 having tapered edge 5, screening 6 and orifices for attachment adhesives 7 reinforcing screen 14 and the small mesh screen 15 covering the entire opening of the rectangular frame.

Figure 2:
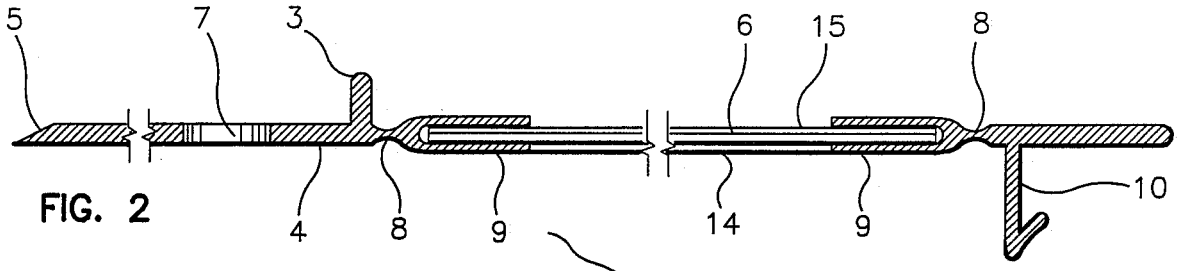
FIG. 2 is a sectional end view of a section of rain gutter screen.

FIG. 2 shows the tapered edge 5 of the roof tab 4, the adhesive orifice 7, the membrane hinges 8, the screening 6 attached to the longitudinal support members 9 and the longitudinal gutter attachment section 10, the reinforcing screen 14 and the small mesh screen 15.

Figure 3:
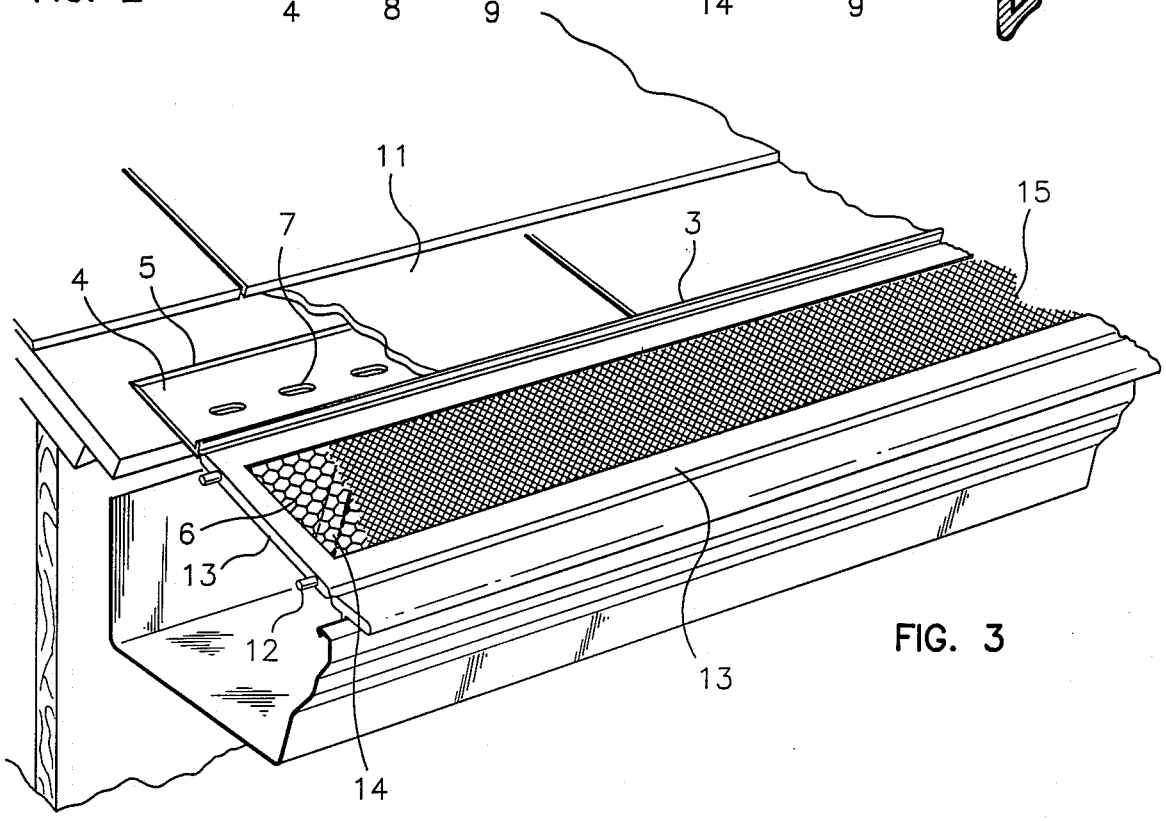
FIG. 3 is a partially sectional top perspective view of an installed section of gutter screen.

FIG. 3 is a top perspective view of the installed section 1 of gutter screen. The tapered edge 5 of the roof attachment tab 4 extending beneath terminal roof covering 11 a distance determined by the depth gage 3. Orifices 7 for applying adhesives or other fasteners are shown in the surface of the roof attachment tab 4. Connecting pins 12 in the ends sections of the gutter section frame 13 for fastening means for the sections of gutter frame. The reinforced screening 6 comprising reinforcing members 14 and smaller mesh screening 15 is shown enclosed by frame members 13.

The individual gutter screen sections are installed with the roof attachment tabs inserted under the roof shingles, or other covering, to the limits of the depth gage. The terminal frame member with the attachment section is frictionally fastened to the rain gutter edge. The individual screen gutter screens are then fastened edge to edge for a continuous line of gutter screens.

I claim:

1. A rain gutter screen apparatus comprising:

a. a first section connected to one end of a second section by a first hinge and a third section connected to an other end of the second section by a second hinge;

b. the first section comprising:

a horizontal member; an upwardly extending vertical segment on the horizontal member parallel to an edge of the second section to place the second section at a fixed distance from a lower edge of a roof; and a plurality of fastening orifices in the horizontal member;

c. the second section comprising:

a rectangular screen frame; at least two connecting pins in the screen frame to fasten at least one screen frame to another screen frame; a screen securing chamber in the frame; a screen assembly having a first screen of heavy wire and a large mesh openings, a second screen of lighter wire with smaller mesh openings and a reinforcing member to support the first and second screens; and a portion of the periphery of the screen assembly being inserted into and secured in place by the chamber; and d. the third section comprising: a horizontal member; a continuous longitudinal array of ports in the horizontal member; and an attachment means on the horizontal member to clamp the third section to a rain gutter.

* * * * *